United States Patent [19]

Ballard

[11] Patent Number: 4,524,632

[45] Date of Patent: Jun. 25, 1985

[54] SELECTING MECHANISM

[75] Inventor: Louis F. Ballard, Medina, Ohio

[73] Assignee: MTD Products Inc., Cleveland, Ohio

[21] Appl. No.: 594,844

[22] Filed: Mar. 29, 1984

[51] Int. Cl.[3] ..... G05G 9/00

[52] U.S. Cl. ..... 74/471 R; 74/502; 192/48.9

[58] Field of Search ..... 74/471 R, 502; 192/48.9, 99 S

[56] References Cited

U.S. PATENT DOCUMENTS

| | | | |
|---|---|---|---|
| 2,613,547 | 10/1952 | Stewart | 74/471 R |
| 3,640,155 | 2/1972 | Waner et al. | 74/471 R |
| 4,432,191 | 2/1984 | Schmitt | 192/99 S |

*Primary Examiner*—Larry I. Schwartz
*Assistant Examiner*—David W. Westphal
*Attorney, Agent, or Firm*—Woodling, Krost, Rust & Hochberg

[57] ABSTRACT

Selecting mechanism which provides for alternate connection as desired between a selected device or clutch of a plurality of devices or clutches (32, 33) with an actuator or dead-man lever (16), by sliding a bar member (21) carried in a block member (17) operatively connected to the actuator or dead-man lever (16) so as to interlock the bar member (21) with only one of a plurality of engaging members (24, 25) each of which is independently connected with one of said devices or clutches (32, 33) selected to be controlled by movement of the actuator or dead-man lever 16.

10 Claims, 3 Drawing Figures

SELECTING MECHANISM

FIELD TO WHICH INVENTION RELATES

My invention relates to a mechanism for selectively determining which connection of a plurality of available connections is to be made as desired. It is useful in the making of such an interconnection as may be selected between a number of available alternative interconnections.

An example of a utilization to which my mechanism may be adapted, among other utilizations, is a garden tiller having rotating tines which may be rotated in a forward driving direction upon actuation of a forward clutch or rotated in a rearward driving direction upon actuation of a rearward clutch.

STATEMENT OF THE INVENTION

An object of my invention is to provide for the convenient and facile interconnection of an actuator, such as for example a dead-man lever, mounted on an appliance, such as for example a garden tiller having forward rotatable tines and rearward rotatable tines, and with a selected one of a plurality of devices each adapted to provide driving movement in a direction independent of the driving movement provided by other of said plurality of device, such as for example forward and rearward driving clutches associated with the tiller.

Another object is to provide selecting mechanism readily adapted to provide the interconnection between an actuator such as a dead-man lever with a selected one of a plurality of alternatively available driving control devices such as clutches.

Another object is to provide an easily operable mechanism for readily and quickly changing the operative connection between an actuator, such as a dead-man lever, from one to another of a plurality of independently driven devices such as clutches, each controlling a different operation.

Other objects and advantages may be observed from the following description of the invention in conjunction with the several drawings.

FIGURES OF THE DRAWINGS

DESCRIPTION OF THE INVENTION HEREIN DISCLOSED

My mechanism includes a guide member 11 in the form of an elongated box, preferably stamped of sheet metal to the shape shown and having an open top. In use, the top is covered by a plate or shield that is part of the appliance, such as a garden tiller, to which the mechanism is mounted. The guide member 11 has tabs or extensions 12 at its opposite ends for use in mounting the guide member to a support, such as an appliance. Holes 13 in tabs 12 are for accommodating screw bolts used in mounting the mechanism to an appliance and holding a plate or shield over the guide member 11.

Mounted to the appliance, such as a garden tiller having tines adapted to rotate in one direction for providing forward motion to the tiller and alternatively to rotate in an opposite direction for providing rearward motion to the tiller, is a bracket 14 located at the rear end of the appliance. This bracket 14 is for the support of the controls for the appliance in a position convenient to the operator of the appliance.

Figure 2:
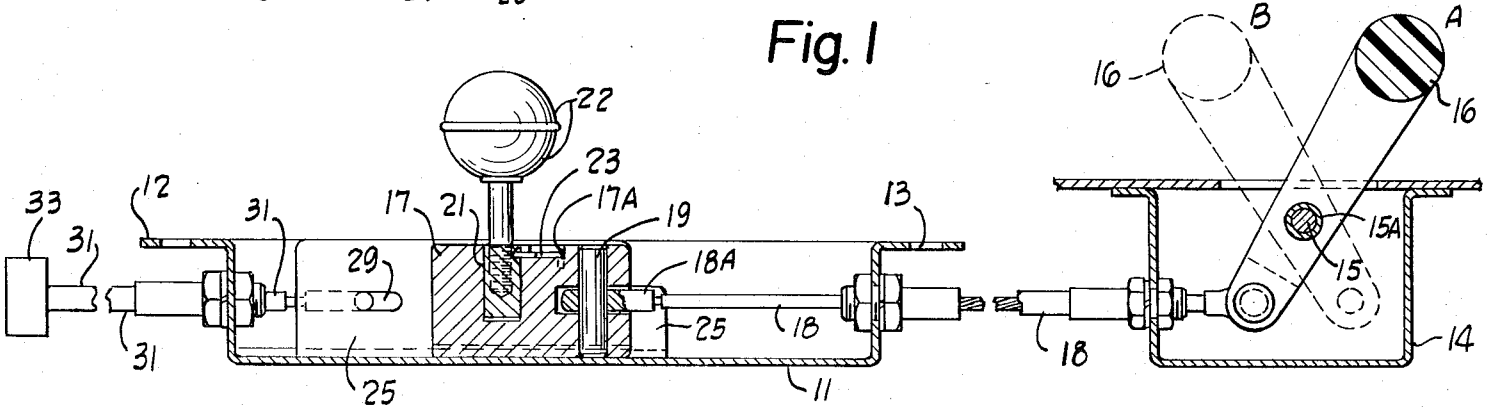
FIG. 2 is a longitudinal sectional view of my mechanism taken through the line, and in the direction of the arrows, 2—2 of FIG. 1

This bracket 14 by means of pivot pin 15 pivotally carries an actuator or dead-man lever 16. The arrangement of the actuator 16 is such that when manually held in one position by the operator of the appliance, the actuator is in the position indicated in full lines at position "A" in FIG. 2. In FIG. 2, a bias is provided for resiliently urging the actuator 16 from position indicated at "A" to a position indicated at "B" (shown in broken lines). This bias may be provided by a coil spring 15A disposed around pivot pin 15 or by any other appropriate means. The operator of the appliance may by manually holding the lever 16 in position "A" maintain it against the bias on the lever in position "A". Upon the operator releasing his grip or hold on lever 16 permits it to move under the bias on it to its position indicated as "B" in FIG. 2.

Figure 3:
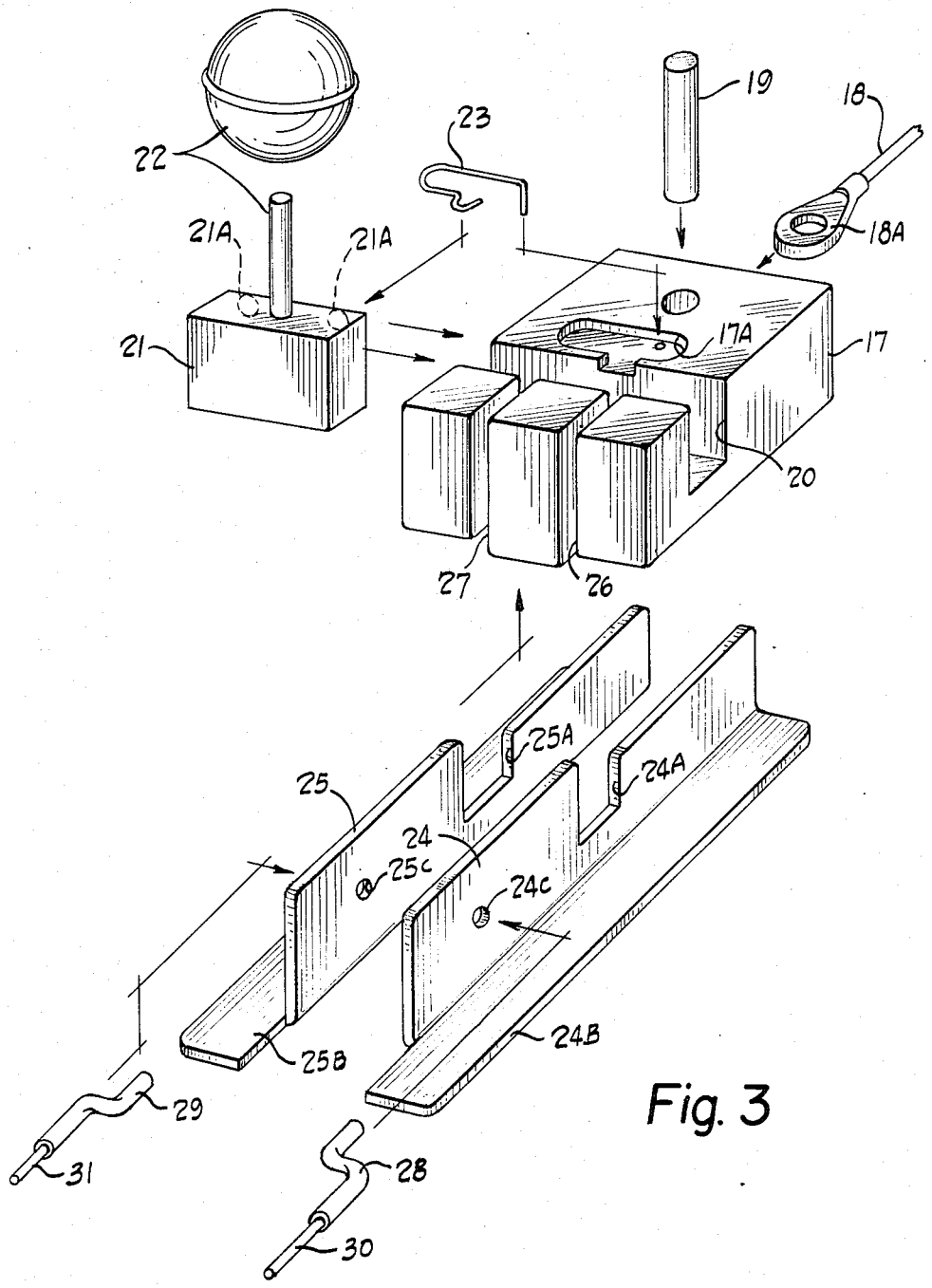
FIG. 3 is an exploded view of the internal parts of my mechanism and showing the structure of the parts in disassembled arrangement.

Slidably mounted in guide member 11 so as to be able to slide longitudinally thereof is a block member 17, preferably of steel, having the structure particularly shown in perspective in FIG. 3. This block member 17 has formed in its upper face a recess 17A for accommodating a detent spring 23 having the shape shown in FIG. 3.

A first linkage means or cable 18 connected to actuator 16 as shown is also connected to block member 17 by means of a pin 19 disposed vertically in the block member 17 and a terminal connection 18A on the end of cable 18. Swinging movement of the lever 16 is translated into longitudinal sliding movement of block member 17 in guide member 11.

The block member 17 has a transverse slot 20 extending therethrough from side to side and extending partially downward from its upper face. The slot 20 provides one portion adjacent a first side of block member 17 and a second portion adjacent the opposite side of block member 17.

Disposed in the slot 20 and slidably therealong from side to side of the block member 17 is a bar member 21, preferably of steel, the bar member 21 is shorter in length than is the slot 20 in length, and preferably slightly more than half the length of the slot 20 so as to slide from the one portion of the slot to the second portion of the slot.

To limit "hunting", or undesired movement from vibration or the like, of bar member 21 in the slot 20, the spring detent 23 is disposed to engage alternately spaced detent dwells on recesses 21A in the side of the bar member facing the detent 23.

The bar member 21 may be conveniently shifted back and forth transversely of block member 17 in the slot 20 by means of a shifting lever 22 having a knob portion on its upper end. The operator of the appliance may thus manually shift the bar member 21 from one position adjacent one side of block member 17 to another position adjacent the opposite side of the block member 17, and then back again to the first position.

Disposed within the guide member 11 adjacent its bottom wall, and slidably disposed in parallel longitudinal slits 26 and 27 in the bar member, are two parallel engaging members 24 and 25, respectively, these engaging members 24 and 25 have the shape better shown in FIG. 3. They have flat horizontal base portions 24B and 25B, respectively, which slide along longitudinally on the bottom wall of guide member 11.

The engaging members 24 and 25 are provided with similar notches 24A and 25A, respectively, through the upright portions of the engaging members. The width of notches 24A and 25A is slightly greater than the width of slot 20 in block member 17 and slightly greater than the width of bar member 21 so that bar member 21 may freely slide in slot 20 transversely of block member 17 and alternately into a notch 24A or a notch 25A and thus interlock as may be selected with one engaging member 24 or another engaging member 25 as may be selected by the operator.

The engaging member 24 near one end is provided with a transverse hole 24C and the engaging member 25 near a corresponding one end is provided with a transverse hole 25C. The holes 24C and 25C are at about the same level as shown.

Hooked or engaged in hole 24C is a steel hook member 28 and hooked in hole 25C is a steel hook member 29. The hook members 28 and 29 have the configuration shown in the drawings and particularly in FIG. 3.

Firmly secured to hook member 28 is a first connecting member 30 which may be a cable or other suitable linkage. Firmly secured to hook member 29 is a second connecting member 31 which may be a cable or other suitable linkage means. The connecting means 30 and 31 extend through openings in the end wall of guide member 11.

Figure 1:
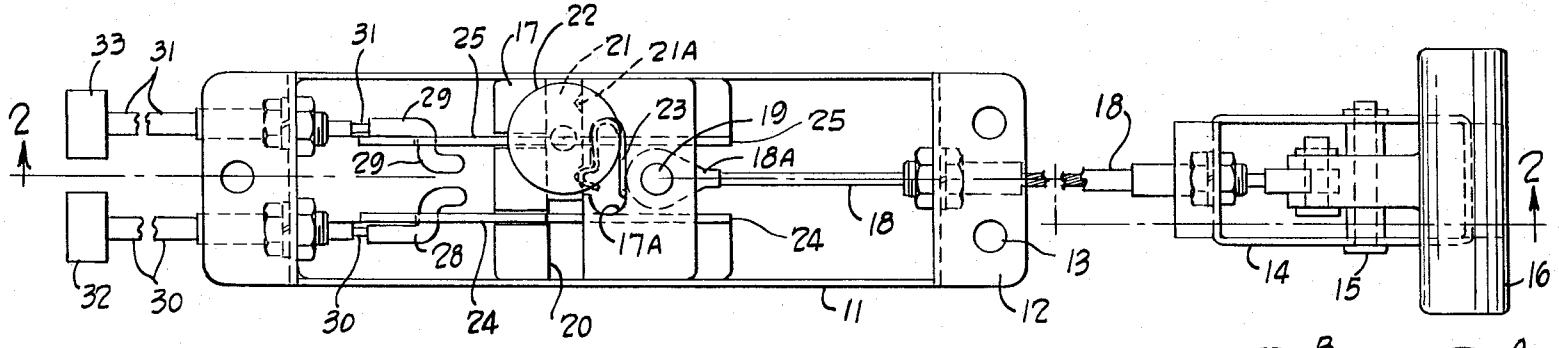
FIG. 1 is a plan view of my improved selecting mechanism with cover or top plate removed to show the interior operative parts.

Shown in block form is a first device 32 to be controlled. This first device 32 for example may be a clutch of a garden tiller and biased to drive the tines in a direction to move the tiller forwardly upon the clutch being released from external restraint. The connecting means or cable 30 is connected to the first device 32 (forward biased clutch) so as to permit the first device 32 under its bias to provide forward movement unless and until the first device 32 is restrained against its bias by a pull on connecting means 30 in a direction opposing such bias, such as to the right as seen in FIGS. 1 and 2.

Also shown in block form is a second device 33 to be controlled. The second device for example may be a clutch of a garden tiller and biased to drive the tines in a direction to move the tiller rearwardly upon the clutch being released from external restraint. The connecting means or cable 31 is connected to the second device 33 (rearward biased clutch) so as to permit the second device 33 under its bias to provide rearward movement unless and until the second device 33 is restrained against its bias by a pull connecting means 31 in a direction opposing such bias, such as to the right shown in FIGS. 1 and 2.

Upon the operator desiring the actuator 16 to be operatively connected so as to control device 32, then the bar member 21 is slid transversely in slot 20 so as to cause the bar member to enter notch 24A and thus interlock with engaging member 24, and through hook 28 and first connecting means or cable 30 to device 32. At the same time that block member 17 is slid into notch 24A so as to interlock with engaging member 24. It clears engaging member 25 so as not to interengage with engaging member 25. Thus, actuator 16 will not then be operatively connected with device 33.

Upon being mounted on a garden tiller, the mechanism assures that the actuator or dead-man control is operatively connected to only one of a plurality of devices such as clutches and to no other. In this manner, upon the proper interconnection being made safety is assured so that upon the actuator or dead-man lever 16 being released and the particular clutch which controls the forward rotational movement of the tines is operated so as to discontinue such forward rotational movement of the tines. Conversely, upon the proper interconnection being made, safety is assured so that upon the actuator or dead-man lever 16 being released and the particular clutch which controls the rearward rotational movement of the tines is operated so as to discontinue such rearward rotational movement of the tines.

Thus, when the operator of the tiller desires forward rotational movement of the tines, the bar member 21 is manually moved in slot 20 to make the appropriate interconnection, and when the operator desires rearward rotational movement of the tines in either of the forward or rearward movements the actuator or dead-man lever may thus be properly connected to the device or clutch which controls the then movement of the tines.

The bias of the particular device or clutch 32 or 33 then operatively connected to block member 17 and then through cable 18 to dead-man lever 16 imposes a pull or tension which opposes movement of the actuator or dead-man lever 16.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A selecting mechanism for operatively connecting an actuator and a selected one of a plurality of devices to be moved by the actuator, each of said devices being biased to move in a first direction, the said actuator being movable in another direction from a first position to a second position, comprising in combination an elongated guide member adapted to be mounted in fixed position, a block member slidably mounted to said guide member for slidable movement longitudinally thereof, linkage means connecting said block member and said actuator for movement of said block member in accordance with the movement of said actuator from said first position to said second position, said block member having a slot disposed transversely thereof, a bar member slidably mounted in said slot for lateral movement between different positions spaced laterally in said block member, a plurality of spaced apart engaging members extending longitudinally of said block member and slidable relative thereto, connecting means independently connecting each of said engaging members to one of said devices respectively, each of said engaging members having a notch formed therein adapted to lockingly receive said bar member upon sliding of the bar member laterally in said slot to a position to be received in the notch of a respective engaging member and free of reception in a notch of other engaging members, the arrangement providing for operative connection of the said actuator with a selected device of said plurality of devices by slidably moving said bar member transversely of said slot to be received only in the notch of an engaging member connected to the selected device.

2. Mechanism as claimed in claim 1 and in which said actuator is a dead-man lever operable by the operator of an appliance to which the said mechanism is attached for control of a plurality of said devices associated with said appliance.

3. Mechanism as claimed in claim 2 and in which said plurality of devices are clutching devices associated with the appliance for alternately providing forward and rearward drive for the said appliance.

4. Mechanism as claimed in claim 1 and including a selecting lever attached to said bar member for manual movement of said bar member in said slot in the block member.

5. Mechanism for selecting the direction of movement of an appliance having a first device for imparting movement of the appliance in a first direction and a second device for imparting movement of the appliance in a second direction, the said devices being biased to impart movement in said first and second directions, the mechanism comprising in combination a guide member adapted to be carried by the appliance, a block member slidable along and relative to said guide member, said block member having a slot formed therein to provide opposite end portions of the slot, a bar member positioned in said slot and movable therealong to spaced positions in said opposite end portions, respectively, of said slot, actuating means for moving said block member along said guide member, first and second engaging members slidably mountable along and relative to said block member alternately athwart said slot to said opposite end portions of the slot to engage said bar member upon movement of the bar member in said slot to one of said opposite end portions and out of the other of said opposite end portions, and first connecting means connecting said first engaging member to said first device and second connecting means connecting said second engaging member to said second device, movement of said bar member to alternate of said positions in said slot to selectively engage one only of said engaging members, causing said block member to be operatively connected through one of said first and second connecting means to a selected device of said devices to be operated by movement of said block member along said guide member.

6. Mechanism as claimed in claim 5 and including detent means interengaging said block member and said bar member to inhibit free sliding movement of the bar member along said slot.

7. Mechanism as claimed in claim 5 and in which said actuating means is a dead-man lever operatively connected to said block member for manually moving the block member along the guide member in opposition to movement of the block member by bias imparted from one of said devices when operatively connected to one of said engaging members and said bar member in the slot in said block member.

8. Mechanism claimed in claim 7 and including detent means interengaging said block member and said bar member for yieldably resisting movement of the bar member along said slot, and a shifting member attached to said bar member for manually shifting said bar member in said slot to a selected one of said opposite end portions of the slot to engage a selected one of said engaging members.

9. Selecting mechanism for selectively connecting actuating means to one of a plurality of devices to be actuated as desired, comprising the combination of a block member adapted to be moved along a first path by the actuating means, a bar member movable relative to said block member in a second path athwart said first path, to a plurality of alternate positions, and a plurality of engaging members each connected to one of said devices, and means for manually moving said bar member in said second path between said alternate positions to selectively operatively engage the block member and one of said devices.

10. The mechanism claimed in claim 9 and including an actuator for moving said block member in said first path, a guide for guiding the movement of the block member in said first path, and slot means in said block member for accommodating said bar member in its movement in said second path.

* * * * *